US009963888B2

(12) United States Patent
Ledet

(10) Patent No.: US 9,963,888 B2
(45) Date of Patent: May 8, 2018

(54) WORK PLATFORM FOR COILED-TUBING DOWNHOLE OPERATIONS

(71) Applicant: Clement Ledet, Hammond, LA (US)

(72) Inventor: Clement Ledet, Hammond, LA (US)

(73) Assignee: Coil Access Platform System, Kenner, LA (US)

( * ) Notice: Subject to any disclaimer, the term of this patent is extended or adjusted under 35 U.S.C. 154(b) by 0 days. days.

(21) Appl. No.: 15/239,529

(22) Filed: Aug. 17, 2016

(65) Prior Publication Data

US 2018/0051474 A1 Feb. 22, 2018

(51) Int. Cl.

| | |
|---|---|
| ***E04G 3/24*** | (2006.01) |
| ***E21B 19/22*** | (2006.01) |
| ***E04G 5/14*** | (2006.01) |

(52) U.S. Cl.

CPC ..... *E04G 3/24* (2013.01); *E04G 5/14* (2013.01); *E21B 19/22* (2013.01)

(58) Field of Classification Search

CPC ..... E21B 15/00; E21B 15/006; E21B 15/04; E21B 19/22; E21B 41/00; E04G 5/14; E04G 3/24; B66B 9/00

See application file for complete search history.

(56) References Cited

U.S. PATENT DOCUMENTS 1,522,309 A * 1/1925 McEwen ..... E21B 15/00 403/176
1,776,344 A * 9/1930 Besse ..... E21B 15/00 403/169
1,776,345 A * 9/1930 Besse ..... E21B 15/00 403/389
4,442,903 A * 4/1984 Schutt ..... C23F 13/02 166/385
5,435,395 A * 7/1995 Connell ..... E21B 17/025 166/384
5,454,419 A * 10/1995 Vloedman ..... B29C 55/22 166/277
6,681,894 B1 * 1/2004 Fanguy ..... E04G 1/36 182/113
8,302,736 B1 * 11/2012 Olivier ..... E21B 15/00 166/379
8,628,275 B1 * 1/2014 Trader ..... E02B 17/0034 405/211
9,316,067 B1 * 4/2016 Lu ..... E21B 19/08
2006/0231267 A1 * 10/2006 Wood ..... E21B 7/02 166/379

(Continued)

*Primary Examiner* — Katherine W Mitchell
*Assistant Examiner* — Shiref M Mekhaeil
(74) *Attorney, Agent, or Firm* — Keaty Law Firm LLC

(57) ABSTRACT

A work platform for coiled-tubing downhole operations apparatus and method, for safe, efficient, and relatively inexpensive extended access to the elevated top of the section of riser pipe necessary for the use of coiled tubing for downhole operations such as drilling, production, intervention, logging, work-over, and fracturing the reservoir. The access is achieved by providing a shell-like riser-pipe sleeve which attaches securely, but removably, to the top section of riser pipe itself, in such a way that balanced support is obtained without placing dangerous strain on the riser pipe, and by providing a shell-like platform securely, but removably, connected to and supported by the riser-pipe sleeve, which in turn is supported by the riser pipe itself.

9 Claims, 8 Drawing Sheets

(56) References Cited

U.S. PATENT DOCUMENTS

| | | | | |
|---|---|---|---|---|
| 2007/0089883 | A1* | 4/2007 | Patton | E21B 19/22 166/355 |
| 2007/0125549 | A1* | 6/2007 | Wood | E21B 7/02 166/380 |
| 2007/0125552 | A1* | 6/2007 | Wood | E21B 7/02 166/385 |
| 2011/0036662 | A1* | 2/2011 | Smith | E04G 1/36 182/37 |
| 2011/0073298 | A1* | 3/2011 | Thompson | E21B 33/02 166/75.11 |
| 2015/0103869 | A1* | 4/2015 | Moscato | E21B 47/065 374/185 |
| 2015/0141190 | A1* | 5/2015 | White | H02K 7/116 475/149 |
| 2015/0144357 | A1* | 5/2015 | Hampson | E21B 19/22 166/381 |
| 2015/0315861 | A1* | 11/2015 | Zachariasen | E21B 19/22 166/385 |
| 2017/0107793 | A1* | 4/2017 | Sherman | E21B 19/22 |
| 2017/0145754 | A1* | 5/2017 | Johnson | E21B 15/00 |

* cited by examiner

WORK PLATFORM FOR COILED-TUBING DOWNHOLE OPERATIONS

BACKGROUND

This invention provides a work platform for coiled-tubing downhole operations apparatus and method, for safe, efficient, and relatively inexpensive extended access to the elevated top of the section of riser pipe necessary for the use of coiled tubing for downhole operations, such as drilling, production, intervention, logging, work-over, and fracturing the reservoir.

The increasing use of coiled tubing, rather than using segmented drill pipe, provides advantages associated with not having to stop and assemble and disassemble drill pipe, and not requiring use of a tall derrick for drilling and for subsequent downhole operations. Coiled-tubing operations make use of a bottom-hole assembly (or "BHA") for all tools, including drilling tools, and therefore do not rotate the tubing. There is thus no need for a rotary table. Operations using coiled tubing can be run in a balanced, over-balanced, or under-balanced state. Running under-balanced helps prevent the forcing of fluids into the underground formation, therefore killing all or part of the well.

Coiled-tubing operations require a length of riser pipe above the well-head and blowout preventer, in order to straighten the tubing. It is normal to have three ten-foot sections of riser pipe, or thirty feet, above the blowout preventer. These sections place the injector and access to the entry point of the tubing between approximately thirty to forty feet above the ground for onshore operations. This elevated equipment has to be inspected and serviced often, and so a safe and stable work platform must be located at the elevated entry point of the riser shaft.

Although an expensive derrick is not needed for the assembly and disassembly of drill pipe, a derrick might be used to provide the elevated work platform. Such a derrick would be expensive, and perhaps prohibitively so for certain operations. Alternatively, scaffolding might be erected to provide a work platform. But such scaffolding is complex, time-consuming to put in place, is subject to being thrown out of adjustment relative to the top of the riser pipe, is difficult to climb, and does not provide an optimum work platform.

There is a thus need for a work platform for coiled-tubing downhole operations that is safe, efficient, and inexpensive relative to a derrick or scaffolding, and further is fixed in place relative to the top of the riser pipe, and may be left in place for extended periods of time.

SUMMARY OF THE INVENTION

The present invention provides a work platform for coiled-tubing downhole operations apparatus and method, for safe, efficient, and relatively inexpensive extended access to the elevated top of the section of riser pipe necessary for the use of coiled tubing for downhole operations such as drilling, production, intervention, logging, work-over, and fracturing the reservoir. The invention is achieved by providing a shell-like riser-pipe sleeve which attaches securely, but removably, to the top section of riser pipe itself, in such a way that balanced support is obtained without placing dangerous strain on the riser pipe, and by further providing a shell-like platform securely, but removably, connected to and supported by the riser-pipe sleeve, which in turn is supported by the riser pipe itself.

BRIEF DESCRIPTION OF DRAWINGS

Reference will now be made to the drawings, wherein like parts are designated by like numerals, and wherein.

DETAILED DESCRIPTION OF THE INVENTION

Referring to all figures generally, embodiments of the work platform for coiled-tubing downhole operations invention method 200 and apparatus 100 are illustrated.

Figure 1:
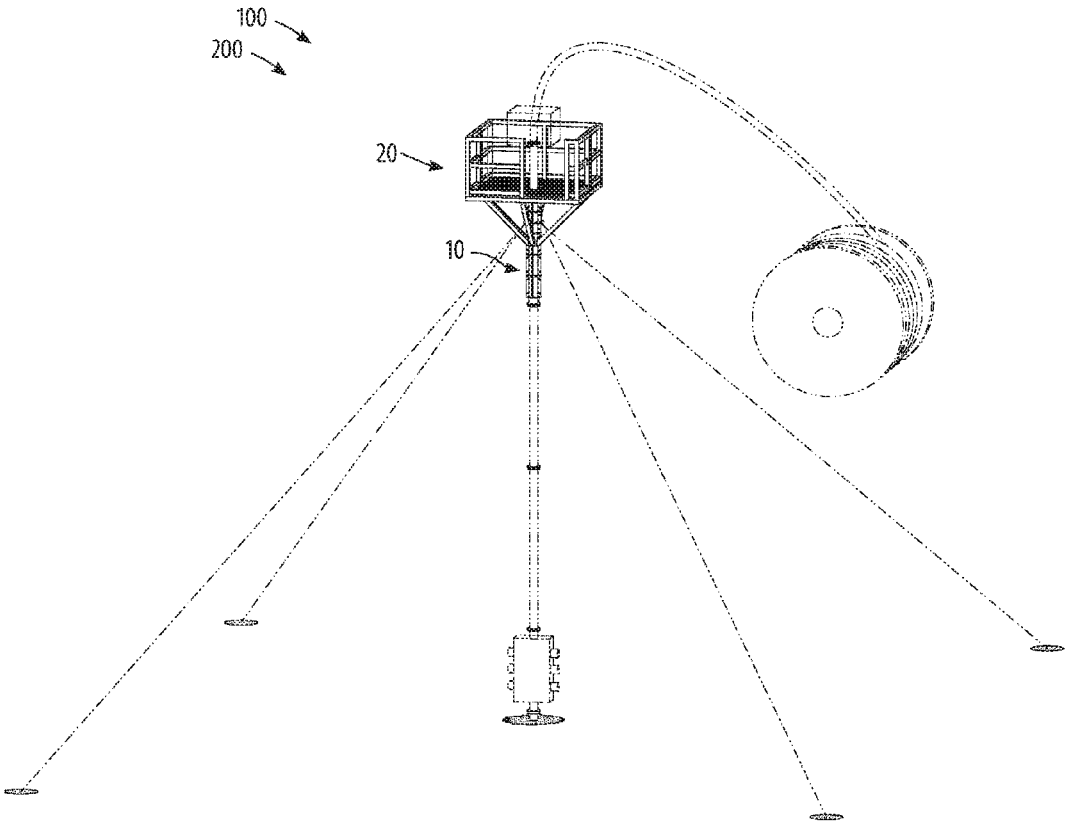
FIG. 1 is a schematic overview of the work platform for coiled-tubing downhole operations of the invention in use.

Referring to FIG. 1, the work platform for coiled-tubing downhole operations provides a safe, efficient, and relatively inexpensive work platform for extended access to the elevated top of a section of riser pipe. The riser pipe is necessary for proper use of coiled tubing. The riser-pipe sleeve sections 10 and the raised platform sections 20 are indicated. Schematically shown is the coiled tubing entering an injector located at the top of the riser pipe, which is rising from a blowout preventer connected to a well head. The work platform for coiled-tubing downhole operations is additionally secured by guy wires running from the riser-pipe sleeve sections 10 to the ground.

A working prototype of a preferred embodiment has been built. The prototype is sized and designed to accommodate a standard riser pipe section of 10 feet in length and 6.25 inches of outside diameter. The size of the floor surface of the prototype is 7 feet by 7 feet, or 49 square feet, with the riser pipe passing through the center of the square, which allows 3 feet of clearance minimum around the riser pipe, with extra floor space in the corners.

Another embodiment with an essentially circular or elliptical floor surface can be made, and may be more appropriate in some circumstances. The working prototype has two sections, each encompassing a half circle, which fit together to form a full-circle shell around the riser pipe, with just one common plane along which the sections are joined, and with the sections being pulled toward one another and toward the riser pipe. Another embodiment might have more than two sections, and therefore more than one single plane of joining. For example, three sections, each encompassing a 120-degree arc, would have three planes of joining, but each section would still be pulled toward the others and toward the riser pipe. An embodiment having more than two sections might be appropriate for very large installations, where size and weight makes handling easier with more numerous smaller sections, or where the disassembled work platform is to be transported in a small vehicle or container.

The working prototype and preferred embodiment of the invention uses welding for permanent attachment of units and sub-units, and steel bolts for secure but removable attachment of sections one to another for installation and use of the invention. Other methods of both permanent and removable attachment are known, and can be used in appropriate circumstances. The working prototype and preferred embodiment is constructed out of aluminum, which is electrically conductive and not magnetic, and steel, which is also electrically conductive and may or may not be magnetic depending upon the specific type of steel. For most common uses, the properties of conductivity and magnetism are irrelevant. In circumstances where those properties are detrimental to the installation, other metals and other materials, such as composite materials, can be used for construction of the work platform for coiled-tubing downhole operations.

The working prototype and preferred embodiment is constructed so that all electrically conductive pieces are in secure electrical contact with all of the other pieces, and with the riser pipe, when the work platform for coiled-tubing downhole operations is installed and in use. In normal use, the work platform for coiled-tubing downhole operations will be elevated between 30 and 40 feet above grade, and will be electrically bonded to earth ground through the riser pipe. Depending upon what other structures are adjacent to the site, the work platform for coiled-tubing downhole operations is likely to function as a lightning rod. Whenever non-conductive materials are substituted for metal materials, consideration should be given to any need for separate electrical bonding of units and sub-units in order to lessen any danger of lightning strike, or other electric shock to persons and equipment.

Figure 2:
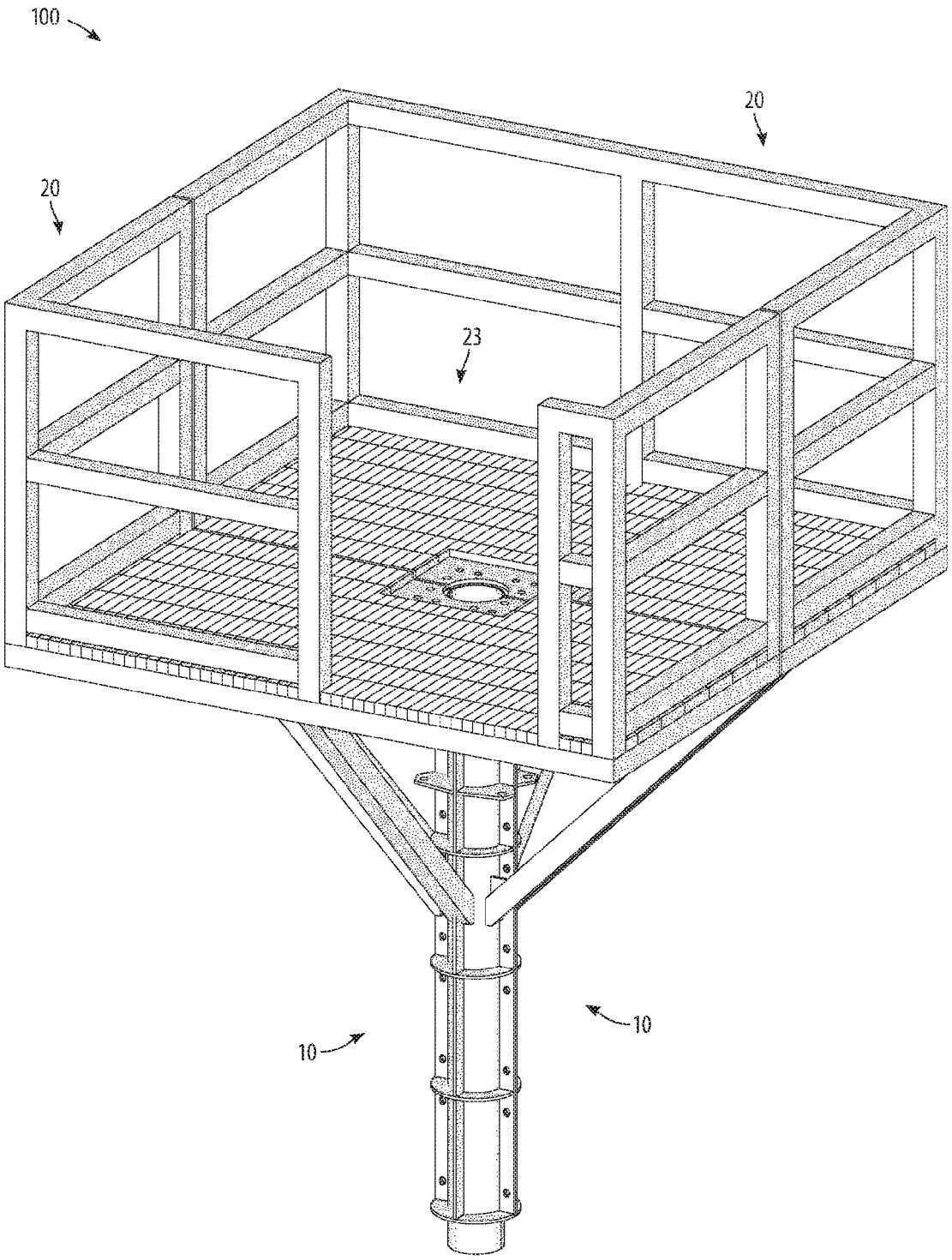
FIG. 2 is a perspective view of the work platform for coiled-tubing downhole operations of the invention, assembled.
Figure 3:
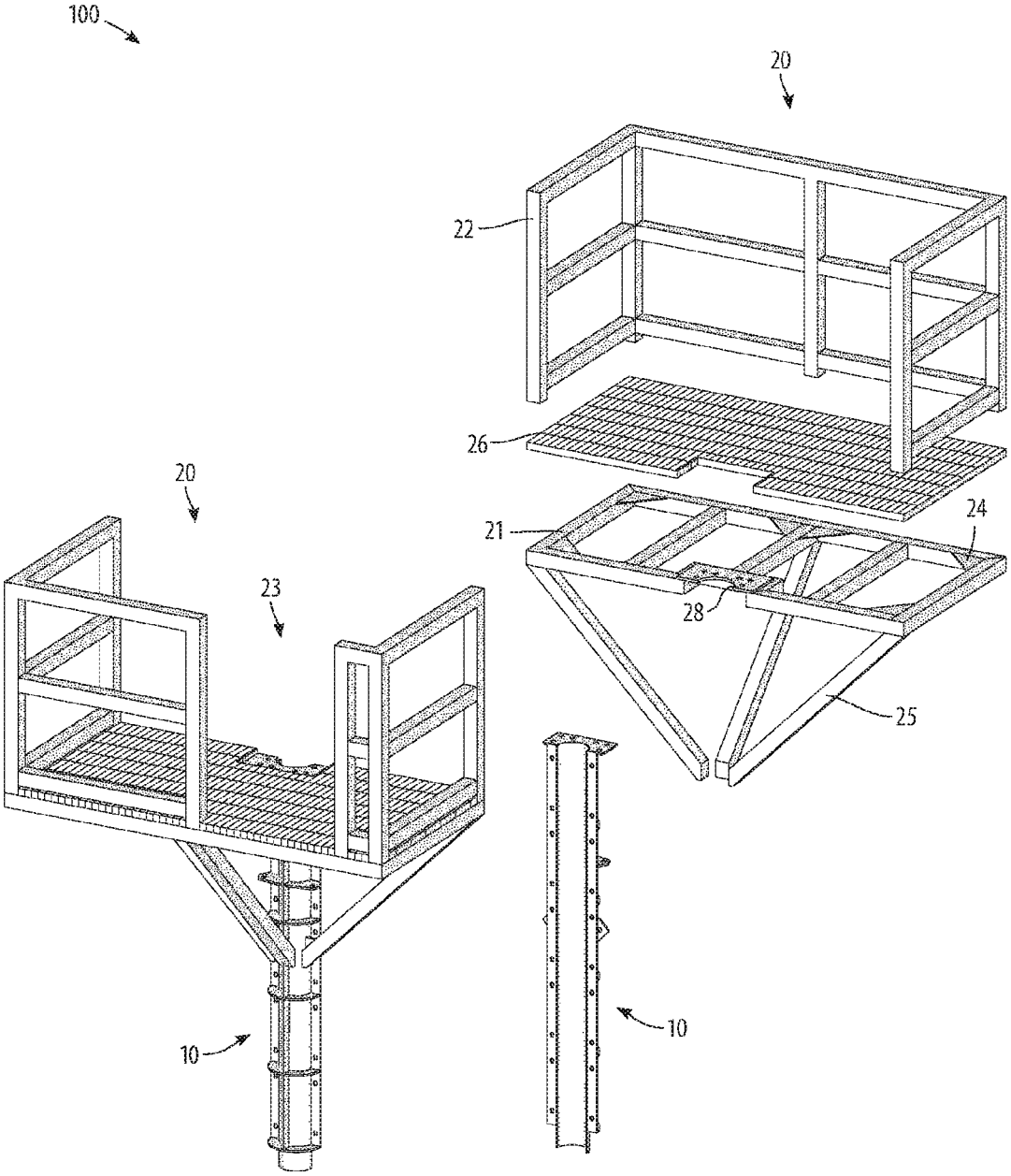
FIG. 3 is a partially exploded view of the work platform for coiled-tubing downhole operations of the invention.

Referring to FIG. 2 & FIG. 3, an embodiment of the invention comprises two riser-pipe sections 10 and two raised platform sections 20. Each raised platform section 20 corresponds to a riser-pipe sleeve section 10. Optionally, the attachment of a raised platform section 20 to a riser-pipe sleeve section 10 can be made as a permanent attachment, such as welding, or as a secure but reversible attachment, such as bolts. The riser-pipe sections 10 are meant to fit tightly against the exterior surface of the riser pipe, like a shell, and are meant to be securely but removably attached one to the other at multiple points by bolts. The raised platform sections 20 are meant to surround the top portion of the riser pipe, and to be securely supported by the riser-pipe sleeve section 10 below, providing a work platform surrounding the top of the riser pipe.

Each raised platform section 20 is made of a tube frame 21 having a guardrail 22, as shown. A working prototype of the invention uses 3-inch×3-inch×⅛-inch aluminum tubing, welded together, as the tube frame 21 and the guardrail 22. A gateway 23 is provided in one of the raised platform sections 20 in order to allow passage of persons and equipment. This gateway should be secured by one of the standard means, such as installing a swinging or a retracting gate, installing chains, straps, or ropes, or installing a panel of strong fabric or mesh. The tube frame 21 is strengthened and stabilized by gussets 24, as shown. A working prototype uses 3/16-inch 6061 Aluminum Plate for the gussets, which are welded in place. Diagonal braces 25 are provided, which distribute the weight of the raised platform section 20 from the tube frame 21 to the midsection of the corresponding riser-pipe sleeve section 10. Again, 3-inch×3-inch×⅛-inch aluminum tubing is a satisfactory material for the diagonal braces 25.

Supported on top of the tubing frame 21 is a grate floor 26, which provides a safe floor surface. A working prototype uses 1.5-inch fiberglass grate, which provides sufficient strength and traction. Such a grate floor can be easily and inexpensively replaced, in sections, if it becomes worn or damaged.

Each raised platform section 20 is provided with a step-back or notch located at the middle of the tubing frame 21 member comprising the inside edge of the platform section 20, which is the edge closest to the other platform section 20 or sections in use. The step-backs, when brought together, form a hole or void essentially at the center of the assembled platform sections 20, through which the riser pipe will pass. Mounted to the step-back portion of each raised platform section 20 is a platform mounting plate 28 having a semi-circular opening sized to fit closely to the outside diameter of the riser pipe, and also having mounting holes in a pattern matching the corresponding sleeve mounting plate 18 disclosed in more detail below.

Figure 4:
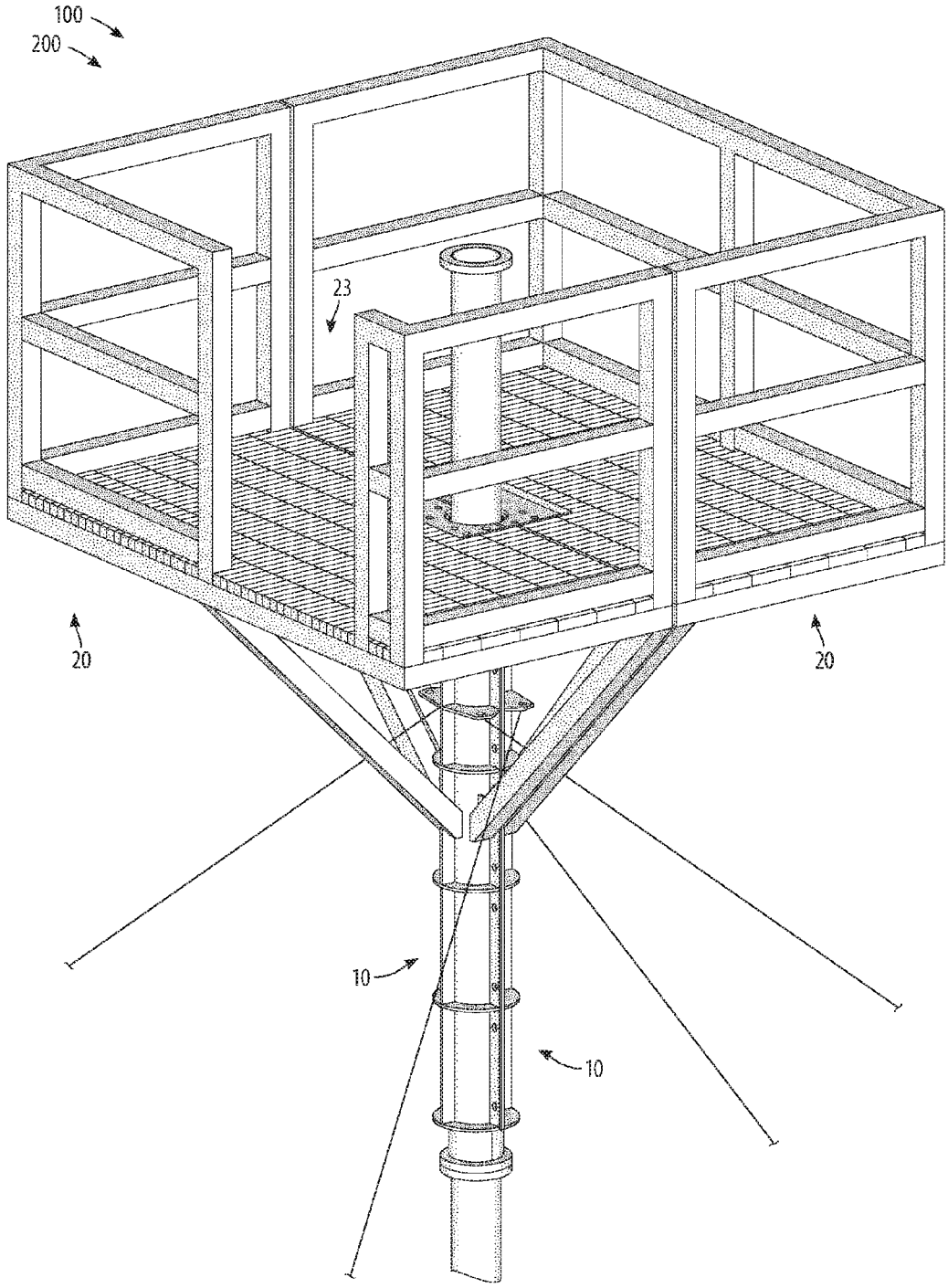
FIG. 4 is a perspective view of the work platform for coiled-tubing downhole operations of the invention in use on a riser pipe, with guy wires attached.

Referring to FIG. 4, assembled and in use, the work platform for coiled-tubing downhole operations surrounds the top portion of the riser pipe, which is the point where the coiled tubing will enter the riser pipe. Normally, there will be equipment, such as an injector, mounted to the top of the riser pipe. The work platform for coiled-tubing downhole operations provides a stable, secure work area at this critical location. The work platform for coiled-tubing downhole operations can be further stabilized with guy wires, as shown. Crossing of the guy wires ensures that each section is pulled toward the other section or sections and toward the riser pipe, avoiding any tendency to pull the assembled unit apart. In use, the lowest edge of the assembled riser-pipe sleeve sections 10 sits directly upon the flange attaching the highest section of riser pipe to the next highest section of riser pipe. The riser-pipe sleeve sections 10 fit closely to the outside surface of the riser pipe, like a shell, and are tightly pulled toward each other and toward the riser pipe, providing a secure attachment spread over a large portion of the riser pipe. The weight of the assembled work platform for coiled-tubing downhole operations is supported by the flange of the riser pipe combined with a large portion of the outside surface of the riser pipe.

Figure 5:
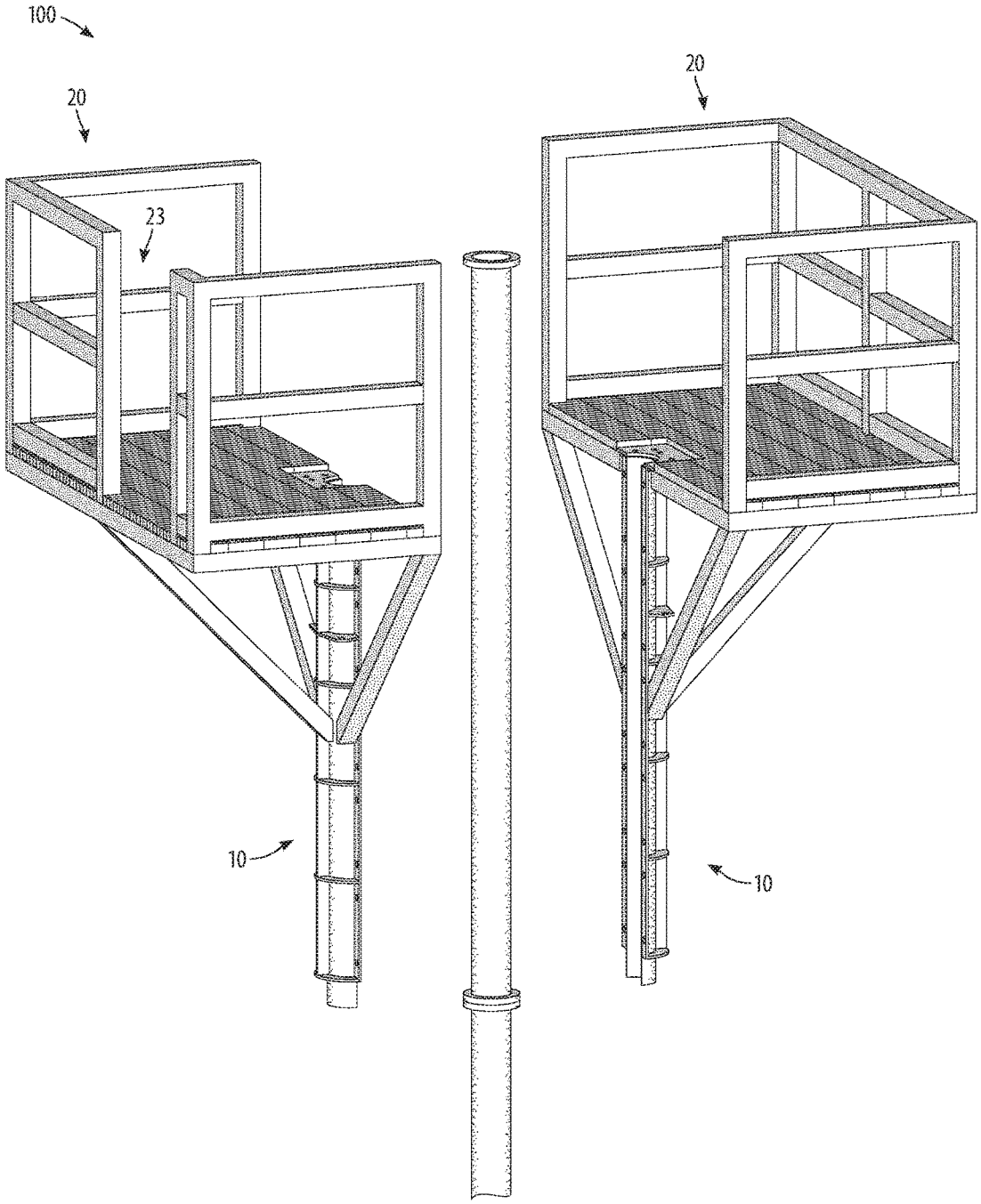
FIG. 5 is a schematic view of the work platform for coiled-tubing downhole operations of the invention in use, before being mounted on a riser pipe.
Figure 6:
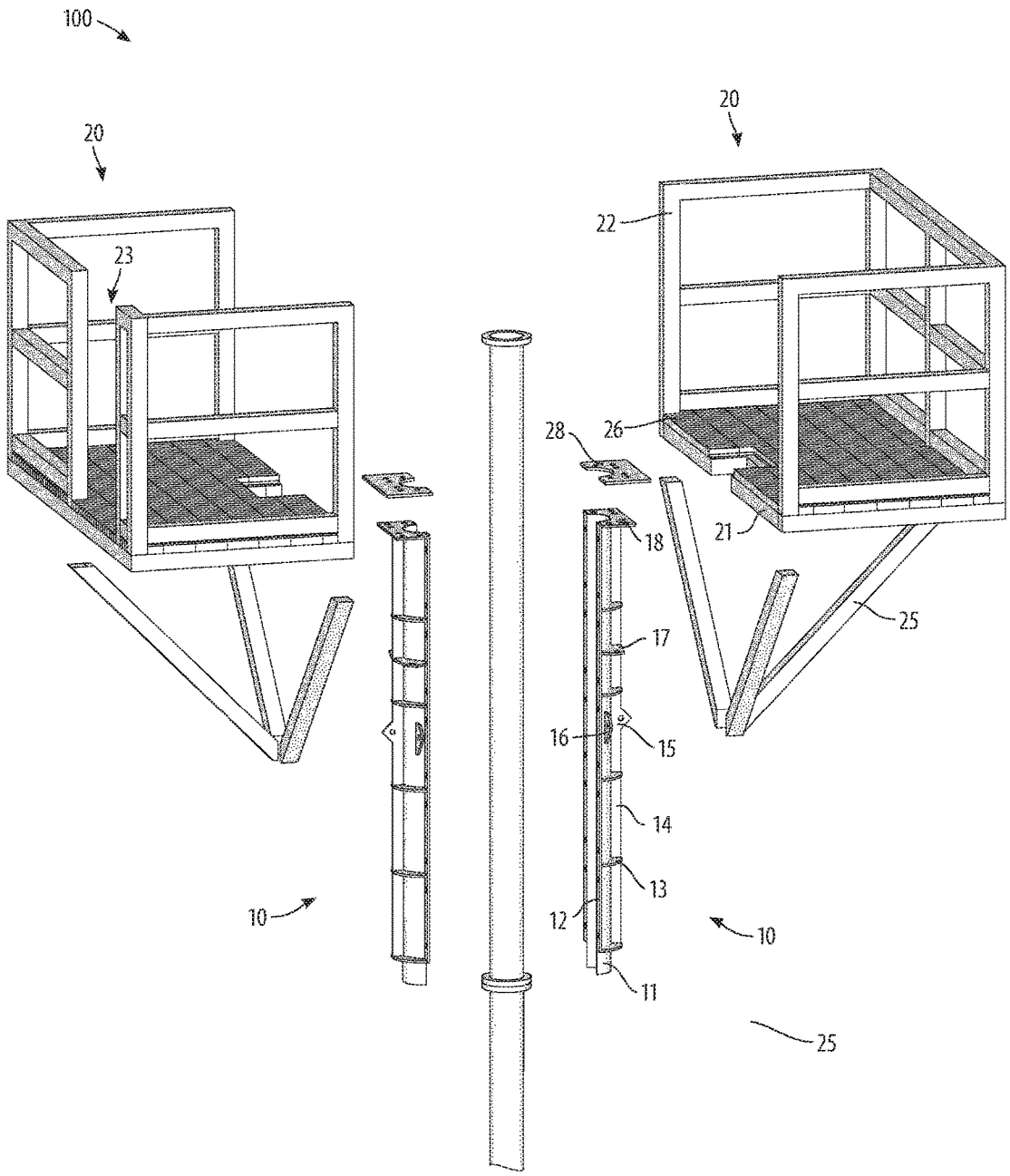
FIG. 6 is a partially exploded view of the work platform for coiled-tubing downhole operations of the invention in use on a riser pipe.
Figure 7:
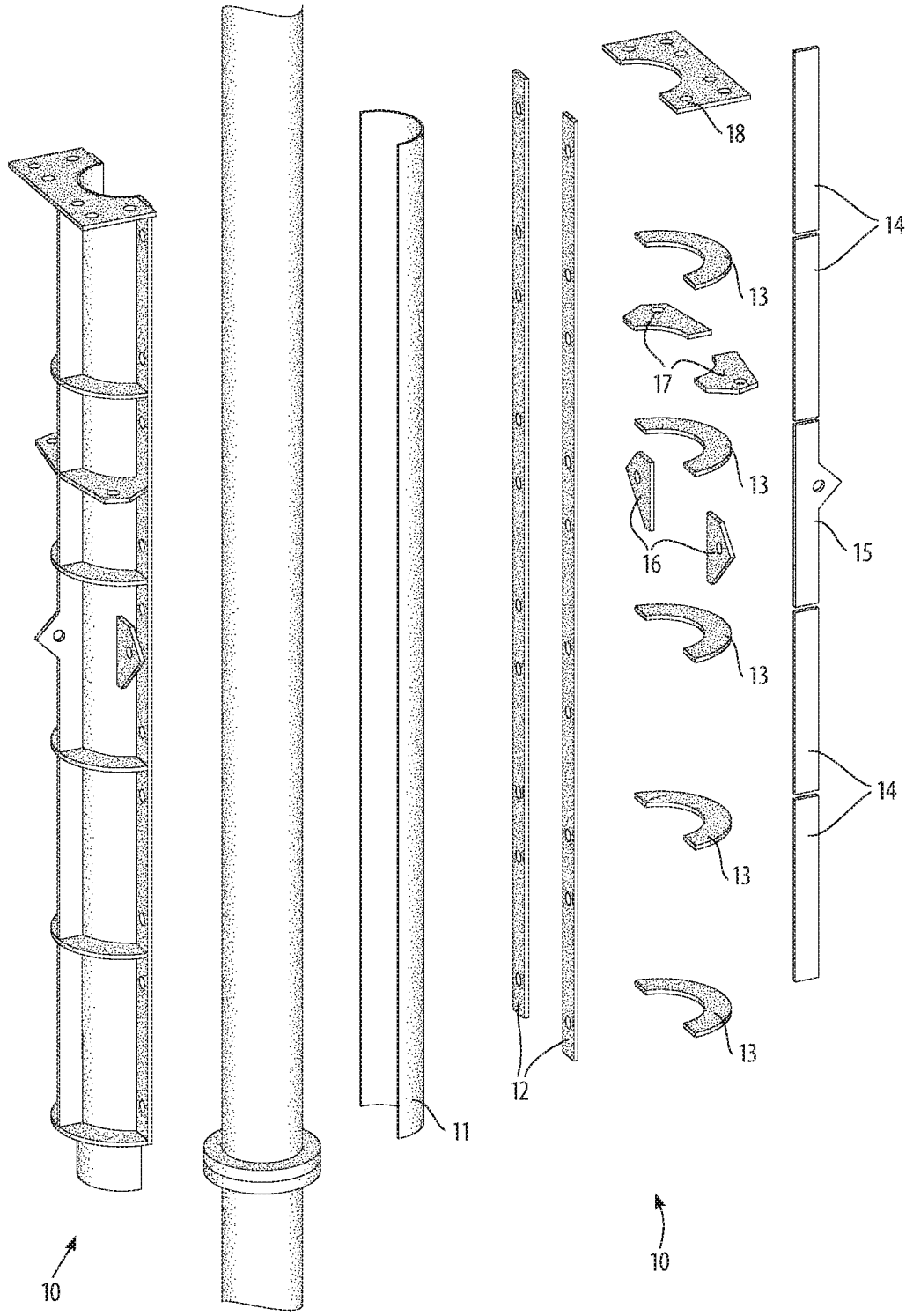
FIG. 7 is a partially exploded view of the riser-pipe sleeve of the work platform for coiled-tubing downhole operations of the invention.

Referring to FIG. 5, FIG. 6, & FIG. 7, the riser-pipe sleeve sections 10 comprise a shaped steel sleeve 11 having a mounting bar 12 on each long edge, reinforced by lateral ribs 13 and vertical ribs 14. Each shaped steel sleeve 11 section is semi-cylindrical and is sized to fit tightly to the outside diameter of the riser pipe. The long dimension of the shaped steel sleeve is oriented vertically, along the riser pipe, in use. When assembled, the sections of shaped steel sleeves 11 form a cylinder or tube surrounding the riser pipe like a shell. In an embodiment for use on riser pipe having a 6.25-inch outside diameter, the inside diameter of the assembled shaped steel sleeve 11 sections is 6.5-inch, the thickness of the shaped steel sleeve is 3/16-inch A36 steel, and the vertical length of the shaped steel sleeve is 7 feet. Two mounting bars 12 are attached, each to a vertical edge of the shaped steel sleeve 11. The mounting bars 12 are attached from the top of the shaped steel sleeve 11 to a point near, but not on, the bottom edge. At the bottom edge, a length of approximately 5 inches is left without a mounting bar 12 attached. This length is left in order to prevent interference with, and preserve access to, the flange of the riser pipe and the connectors used to join the sections of riser pipe. In use, assembled, the mounting bars 12 with attached shaped steel sleeves 11 are brought together and securely fastened one to another by means such as steel bolts.

The outer surface of each shaped steel plate 11 is reinforced with lateral ribs 13 and vertical ribs 14, as shown. In a working prototype and preferred embodiment, the lateral and vertical ribs are made from ⅜-inch A36 steel plate and bar. No reinforcement is placed on the bottom length of approximately 5 inches of the shaped steel plate 11, in order to prevent interference with, and preserve access to, the flange of the riser pipe. A vertical rib with a protruding connection point, called a brace-connector rib 15, is used at approximately the middle of the riser-pipe sleeve 10 section, for connection of a diagonal brace 25. Two additional brace connectors 16 are attached to the outer surface of the shaped steel plate 11 at the approximate middle, as with the brace-connector rib 15. Cable connector ribs 17 are attached to the outer surface of the shaped steel plate 11 in the upper portion of the riser-pipe sleeve 10. The attachment should be made at a point that will allow access in order to connect and disconnect the cables or guy wires, and that will allow the cables to clear the diagonal braces 25 in use. The cables should be connected in a crossing arrangement, so that any given cable will pull the corresponding riser-pipe sleeve 10 section toward the other section or sections and toward the riser pipe.

A sleeve mounting plate 18 is attached at the top edge of the shaped steel plate 11 and mounting bars 12. The sleeve mounting plate 18 has a semi-circular opening sized to fit closely to the outside diameter of the riser pipe and has mounting holes in a pattern matching the corresponding platform mounting plate 28. In use, the sleeve mounting plate 18 and the platform mounting plate 28 for each section are attached one to the other by means such as steel bolts.

Figure 8:
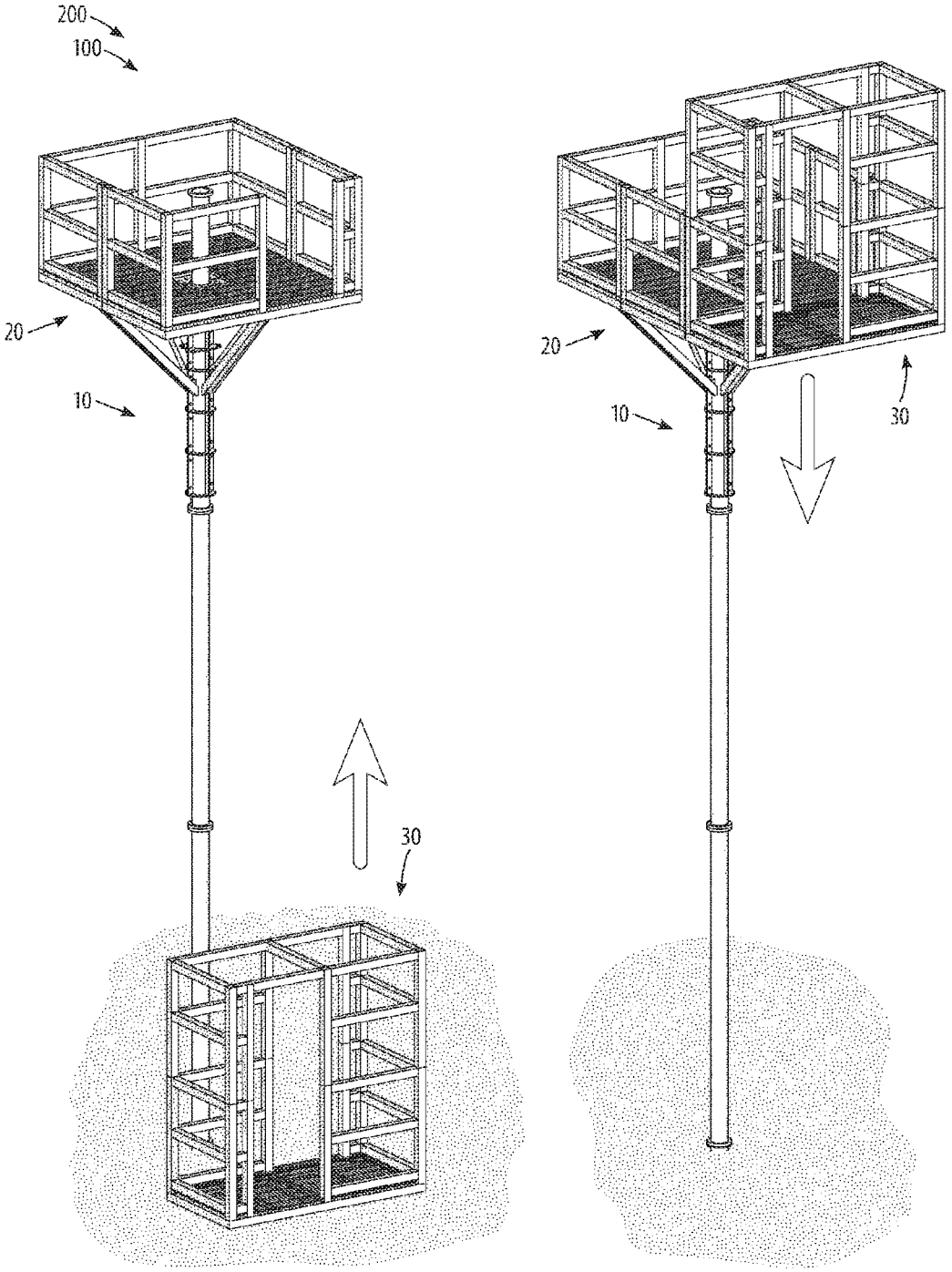
FIG. 8 is a schematic view of an embodiment of the work platform for coiled-tubing downhole operations of the invention having a lift for moving persons and equipment.

Referring to FIG. 8, an embodiment of the work platform for coiled-tubing downhole operations provides an elevator or lift 30 to transport persons and equipment between deck level and work-platform level.

Many changes and modifications can be made in the present invention without departing from the spirit thereof. I therefore pray that rights to the present invention be limited only by the scope of the appended claims.

I claim:

1. A method of performing coiled-tubing downhole operations, on a worksite having joined sections of a riser pipe having a riser-pipe-outside dimension, the method of performing coiled-tubing downhole operations comprising:

(i) providing a work platform for coiled-tubing downhole operations comprising:

(a) two riser-pipe sleeve sections, each further comprising:

(1) a steel plate having a curved shape corresponding to a section of the riser-pipe-outside dimension, and having straight side edges of a first dimension and curved top and bottom edges of a second dimension, and having an inner surface and an outer surface; wherein said first dimension is longer than said second dimension;

(2) two mounting bars, each having a dimension approximately five inches shorter than the first dimension of said side edges of said steel plate, each attached to a corresponding side edge of said steel plate side edges from the top edge to approximately five inches short of the bottom edge, adapted to mount to a corresponding one of said mounting bars on another one of said riser-pipe sleeve section;

(3) a plurality of lateral ribs and vertical ribs attached to the outer surface of said steel plate;

(4) a brace-connector rib attached to the outer surface of said steel plate adjacent the middle of the length of the side edges of said steel plate, adapted as a connection point for a diagonal brace;

(5) two brace connectors attached to the outer surface of said steel plate near the middle of the length of the side edges of said steel plate, adapted as connection points for diagonal braces;

(6) two cable-connector ribs attached to the outer surface of said steel plate at a location between the top edge and the middle of said steel plate, adapted as connection points for cables; and (7) a sleeve mounting plate attached to the top edge of said steel plate, having a semi-circular opening along an inside edge, corresponding to the curved top edge of said steel plate, adapted to fit around a portion of the riser pipe, and having a pattern of mounted holes;

where said riser-pipe sleeve sections are adapted to be mounted one to another to form a fitted sleeve around the riser pipe, with the bottom edge of said steel plate resting upon a lower flange of the riser pipe;

(b) two raised-platform sections, having a perimeter with an inside edge and at least one outside edge, each raised-platform section further comprising:

(1) a tube frame along the perimeter of said raised-platform section and crossing between edges, having a step-back in a middle of said inside edge of said tube frame adapted to accommodate said riser pipe;

(2) a plurality of gussets attached to and strengthening said tube frame;

(3) a guardrail attached to and rising above said tube frame along the outside edges of the perimeter;

(4) a grate floor covering said tube frame;

(5) three diagonal braces attached to said tube frame at outside edges of the perimeter and extending diagonally downward, adapted for connection to said brace-connector rib and said brace connectors of said riser-pipe sleeve section; and (6) a platform mounting plate attached to the step-back middle portion of the inside edge of said tube frame, having a semi-circular opening along said inside edge, corresponding to the riser-pipe-outside dimension, adapted to fit around a portion of the riser pipe, and having a pattern of mounting holes corresponding to the pattern of mounting holes in said sleeve mounting plate attached to said riser-pipe sleeve section;

where said raised-platform sections are adapted to be mounted to a corresponding one of said riser-pipe sleeve sections through connection of said platform mounting plate and said sleeve mounting plate and through connections of said diagonal braces and said brace-connector ribs and said brace connections; and where the mounting of said riser-pipe sleeve sections one to another to form a fitted sleeve around the riser pipe, holds a corresponding mounted raised-platform sections in close proximity one to another, surrounding the riser pipe;

(ii) mounting said work platform for coiled-tubing downhole operations to a top section of the riser pipe, with the bottom edge of said steel plates resting upon the lower flange of the top section of the riser pipe, and with said riser-pipe sleeve sections encompassing the riser pipe, and with said raised platform sections securely connected to the corresponding one of said riser-pipe sleeve sections and therefore held in a position encompassing the upper portions of the top section of the riser pipe; and (iii) utilizing said work platform for coiled-tubing downhole operations to safely support persons and equipment during operations at the top section of the riser pipe.

2. The method of performing coiled-tubing downhole operations of claim 1, further comprising:

(iv) providing a lift to transport persons and equipment to said work platform.

3. The method of performing coiled-tubing downhole operations of claim 1, where said tube frame, said guardrails, and said diagonal braces are made from 3-inch×3-inch×⅛-inch aluminum tube.

4. The method of performing coiled-tubing downhole operations of claim 1, where said tube frame, said guardrails, and said diagonal braces are attached by a welding process.

5. The method of performing coiled-tubing downhole operations of claim 1, where said mounting bars of said riser-pipe sleeve sections are mounted together by steel bolts.

6. The method of performing coiled-tubing downhole operations of claim 1, where said diagonal braces are connected to said brace-connector ribs and said brace connectors by steel bolts.

7. The method of performing coiled-tubing downhole operations of claim 1, where said grate floor further comprises a fiberglass grate floor.

8. The method of performing coiled-tubing downhole operations of claim 1, where said grate floor further comprises a grate floor having a textured non-slip surface, made of a material highly resistant to degradation or slipperiness caused by spilled petroleum formation fluids, drilling muds and fluids, and chemicals used in coiled-tubing downhole operations.

9. The method of performing coiled-tubing downhole operations of claim 1, where each said raised platform section has a floor area of approximately 7 feet by 3.5 feet, creating a work platform of approximately 7 feet by 7 feet in use, assembled, and where each said riser-pipe sleeve section has a vertical length of approximately 7 feet.

* * * * *